US006450847B1

(12) United States Patent
Kashima et al.

(10) Patent No.: US 6,450,847 B1
(45) Date of Patent: Sep. 17, 2002

(54) ENGINE COMPONENT ARRANGEMENT FOR OUTBOARD MOTOR

(75) Inventors: Yukinori Kashima; Hitoshi Watanabe, both of Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/679,424

(22) Filed: Oct. 4, 2000

(30) Foreign Application Priority Data

Oct. 4, 1999 (JP) ..... 11-283238

(51) Int. Cl.[7] ..... B63H 21/10
(52) U.S. Cl. ..... 440/88; 123/196 E
(58) Field of Search ..... 440/52, 77, 88, 440/89, 84; 123/196 E, 494

(56) References Cited

U.S. PATENT DOCUMENTS

| | | | | |
|---|---|---|---|---|
| 4,632,662 | A | 12/1986 | Handa | 440/52 |
| 5,207,186 | A | 5/1993 | Okita | 123/198 E |
| 5,234,363 | A | 8/1993 | Motose | 440/77 |
| 5,501,188 | A | 3/1996 | Fukuoka | 123/196 E |
| 5,514,015 | A | 5/1996 | Okazawa et al. | 440/88 |
| 5,524,597 | A | 6/1996 | Hiki et al. | 123/635 |
| 5,647,315 | A | 7/1997 | Saito | 123/196 AB |
| 5,713,772 | A | 2/1998 | Takashi et al. | |
| 5,765,519 | A | 6/1998 | Watanabe | |
| 5,809,974 | A | 9/1998 | Osakabe | 123/494 |
| 5,829,402 | A | 11/1998 | Takashi et al. | |
| 5,878,726 | A | 3/1999 | Takashi et al. | |
| 5,899,197 | A | 5/1999 | Watanabe et al. | |
| 5,899,778 | A | 5/1999 | Hiroaka et al. | |
| 5,904,604 | A | 5/1999 | Suzuki et al. | 440/84 |
| 5,941,205 | A | 8/1999 | Hiraoka et al. | 123/184.35 |
| 5,984,742 | A | 11/1999 | Kimura et al. | 440/77 |
| 6,045,421 | A | 4/2000 | Hiraoka et al. | 440/77 |
| 6,062,927 | A | 5/2000 | Hiraoka et al. | 440/88 |
| 6,082,236 | A | 7/2000 | Takashi et al. | |
| 6,109,231 | A | 8/2000 | Watanabe et al. | |
| 6,276,340 | B1 * | 8/2001 | Kato | 123/491 |
| 6,296,536 | B1 | 10/2001 | Katayama et al. | |
| 6,298,815 | B1 | 10/2001 | Kashima | |
| 6,302,754 | B1 | 10/2001 | Kashima | |

OTHER PUBLICATIONS

Co–pending patent application: Ser. No. 09/688,511, filed Oct. 16, 2000, entitled Engine Throttle Valve Linkage, in the name of Atsushi Isogawa and Yukinori Kashima, and assigned to Sanshin Kogyo Kabushiki Kaisha.

Co–pending patent application: Ser. No. 09/664,513, filed Sep. 18, 2000, entitled Lubrication System for Outboard Motor Engine, in the name of Toshihiro Nozue, and assigned to Sanshin Kogyo Kabushiki Kaisha.

Co–pending patent application: Ser. No. 09/664,514, filed Sep. 18, 2000, entitled Four–Cycle Engine, in the name of Hitoshi Watanabe, and assigned to Sanshin Kogyo Kabushiki Kaisha.

Co–pending patent application: Ser. No. 09/676,044, filed Sep. 28, 2000, entitled Arrangement for Outboard Motor, in the name of Hitoshi Watanabe, and assigned to Sanshin Kogyo Kabushiki Kaisha.

* cited by examiner

*Primary Examiner*—Jesus D. Sotelo
(74) *Attorney, Agent, or Firm*—Knobbe, Martens, Olson & Bear, LLP

(57) ABSTRACT

An outboard motor has various electrical components mounted on a front side of the crankcase chamber. The crankcase chamber is connected by an electrical line to a negative terminal of a battery in an associated watercraft in order to ground the crankcase chamber. Thus, the electrical components are easily grounded by being connected to the crankcase chamber. An intake silencer of the engine induction system is positioned adjacent the crankcase chamber and at least one of the electrical components is disposed between the silencer and the crankcase member. An oil filter mount is also disposed on the front side of the crankcase chamber. The mount is adapted so that the oil filter can be installed thereon and is tilted along an inclined axis.

39 Claims, 13 Drawing Sheets

ENGINE COMPONENT ARRANGEMENT FOR OUTBOARD MOTOR

PRIORITY INFORMATION

This application is based on and claims priority to Japanese Patent Application No. Hei 11-283238, filed Oct. 4, 1999, the entire contents of which is hereby expressly incorporated by reference.

BACKGROUND OF THE INVENTION

1. Field of the Invention

The present invention principally relates to engines for powering an outboard motor. More particularly, the present invention relates to an arrangement of certain components for such engines associated with outboard motors.

2. Description of the Related Art

Outboard motors are often used to power watercraft. The motors are attached to the transom of the watercraft and include an engine disposed within a power head of the motor. The engine drives a propulsion unit and is thus able to push the watercraft through water.

The powerhead of the outboard motor comprises the engine enclosed within a cowling. The power head usually extends above a transom of the watercraft. As such, the power head can be a significant source of wind drag for the watercraft. Also, a large power head may obstruct the watercraft operator's field of vision.

Various structural designs are used to decrease the size of the power head. For example, a V-type cylinder arrangement allows the engine height to be decreased. However, V-type engines tend to be relatively wide because of the inclined cylinder banks. Additionally, electrical components such as an engine control unit (ECU), a relay box and a fuse box, have traditionally been mounted on the side of the engine. Additionally, in 4-stroke, V-type engines, the intake pipes, as well as the oil filter, are generally situated on the sides of the engine. With all these components situated on the sides of the engines, 4-stroke, V-type engines tend to be quite wide.

SUMMARY OF THE INVENTION

Accordingly, there is a need in the art for an arrangement of engine components of an outboard motor that will decrease the width of the motor and provide satisfactory mounting positions for the components.

In accordance with one aspect, the present inventions includes an outboard motor having a four-stroke engine and an induction system. The engine has a first bank of cylinders and a second bank of cylinders arranged generally in a "V" formation. Each cylinder bank defines a plurality of cylinder bores, which communicate with a crankcase. A piston is reciprocatably disposed in each cylinder bore and drives a substantially vertically-oriented crankshaft disposed in the crankcase. Each cylinder bank has a cylinder head attached thereto, which cylinder head has at least one intake port formed therethrough and opening into an associated cylinder bore. A forward side of the crankcase is defined opposite the cylinder head. The induction system comprises an intake silencer and a plurality of runners extending from the intake silencer to each of the intake ports. The intake silencer is positioned forwardly of the crankcase. An electrical component is mounted on a front surface of the crankcase.

In accordance with another aspect of the present invention, a watercraft comprises an outboard motor and a battery. The outboard motor is mounted onto a transom of the watercraft and comprises an internal combustion engine and an induction system for providing air to a combustion chamber of the engine. The engine has a substantially vertical crankshaft at least partially enclosed within a crankcase. At least a portion of the induction system is positioned forwardly of a front side of the crankcase. An electrical grounding line extends from the battery to the front side of the crankcase. At least one electrical component is positioned between the crankcase and the intake silencer.

In accordance with yet another aspect, the present invention includes an outboard motor comprising an internal combustion engine and an induction system enclosed within a cowling. The engine has an engine body which defines at least one combustion chamber and a crankcase. The crankcase at least partially encloses a substantially vertically-oriented crankshaft therein. The engine body has a front end substantially opposite the at least one combustion chamber. At least a portion of the induction system is disposed forwardly of the front end of the engine body. At least one electrical component is disposed between the front end of the engine body and the portion of the induction system disposed forwardly of the engine body.

Further aspects, features and advantages of this invention will become apparent from the detailed description of the preferred embodiment which follows.

BRIEF DESCRIPTION OF THE DRAWINGS

These and other features of this invention will now be described with reference to the drawings of the preferred embodiment, which embodiment is intended to illustrate, but not to limit, the present invention.

DETAILED DESCRIPTION OF A PREFERRED EMBODIMENT

Figure 1:
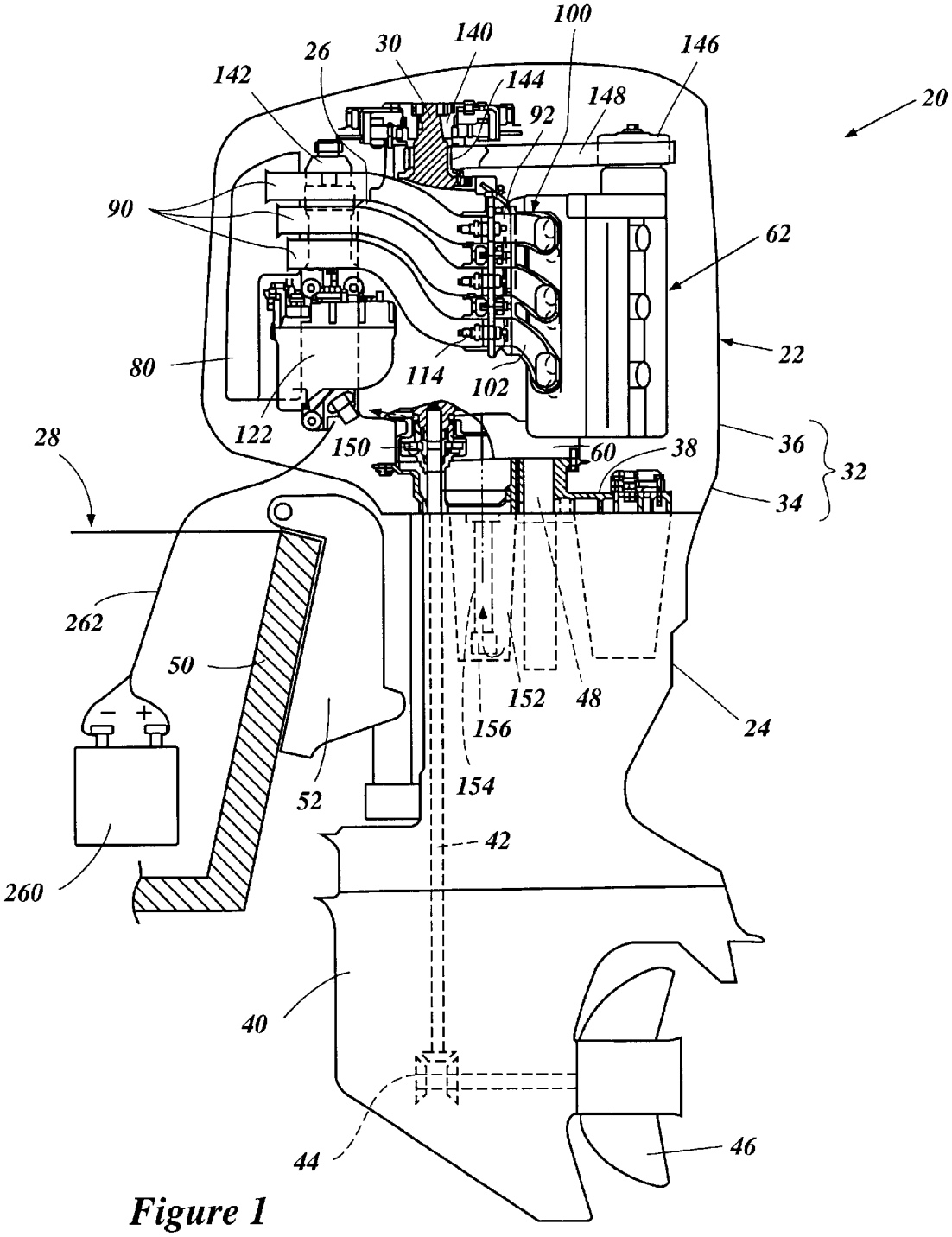
FIG. 1 is a side elevational view of an outboard motor configured in accordance with certain features, aspects, and advantages of the present invention, with a portion of main cowling removed.

With reference initially to FIG. 1, an outboard motor 20 is illustrated therein. The illustrated outboard motor advantageously incorporates a four-stroke V-type engine having an oil filter and certain electrical components arranged and configured in accordance with certain features, aspects, and advantages of the present invention. The configuration results in a more compact motor construction. Although the component arrangement is described below in connection with the illustrated outboard motor, it should be understood that certain features, aspects, and advantages of the present invention can also be used in other applications such as, for example, but without limitation, two-stroke engines and a variety of other land-based vehicle and engine applications.

The illustrated outboard motor 20 generally comprises a power head 22 and a driveshaft housing 24. The power head 22 preferably contains an internal combustion engine 26 that is used to power a watercraft 28 to which the outboard motor 20 is mounted. As will be described, the engine preferably is mounted such that an output shaft 30 of the engine (i.e., a crankshaft) extends in a generally vertical direction when the motor is placed in an position.

The power head 22 includes a protective cowling 32, which surrounds the engine 26 and generally comprises a lower tray portion 34 and a removable main cover portion 36. The lower tray portion 34 and the main cover portion 36 preferably are connected to one another such that the main cover portion 36 can be pivoted or otherwise removed to allow access to the engine 26 contained within the cowling 32. More preferably, the two components 34, 36 are sealed together to substantially protect the engine 26 from excess water contact.

The illustrated lower tray portion 34 contains an exhaust guide plate 38. In the illustrated arrangement, the engine 26 is mounted to the exhaust guide plate 38 and thereby is mounted to the balance of the motor 20.

The driveshaft housing 24 depends from the exhaust guide 38 and terminates in a lower unit 40. A driveshaft 42 is coupled to the crankshaft 30 and extends through the housing 24 to a transmission 44 that is positioned within the lower unit 40. The driveshaft 42 transmits rotational movement of the crankshaft 30 to the transmission 44.

The transmission 44 desirably is a forward/neutral/reverse type transmission so as to drive the watercraft 28 in any of these operational states. The transmission 44 selectively establishes a driving condition of a propulsion device 46. In the illustrated embodiment, the propulsion device is a propeller. Of course, any suitable propulsion device can be used. For example, but without limitation, the propulsion device could be a jet pump unit.

An exhaust passage 48 extends from the engine 26 through the exhaust guide 38 and into the driveshaft housing 24. An exhaust system having a structure generally known in the art is provided to evacuate exhaust gases and combustion products from the outboard motor to the environment.

The outboard motor 20 is attached to a transom 50 of the watercraft 28 using a mount bracket 52 as is generally known to those of ordinary skill in the art. The mount bracket 52 allows the outboard motor 20 to swivel about a turning axis and allows the motor to be pivoted upwardly so that the lower unit is removable from the water.

As used through this description, the terms "fore," "front," "forward" and "forwardly" mean at or to the side of where the mount bracket 52 is located, and the terms "aft," "rear," "reverse" and "rearwardly" mean at or to the opposite side of the front side, unless indicated otherwise or otherwise readily apparent from the context of use.

Figure 2:
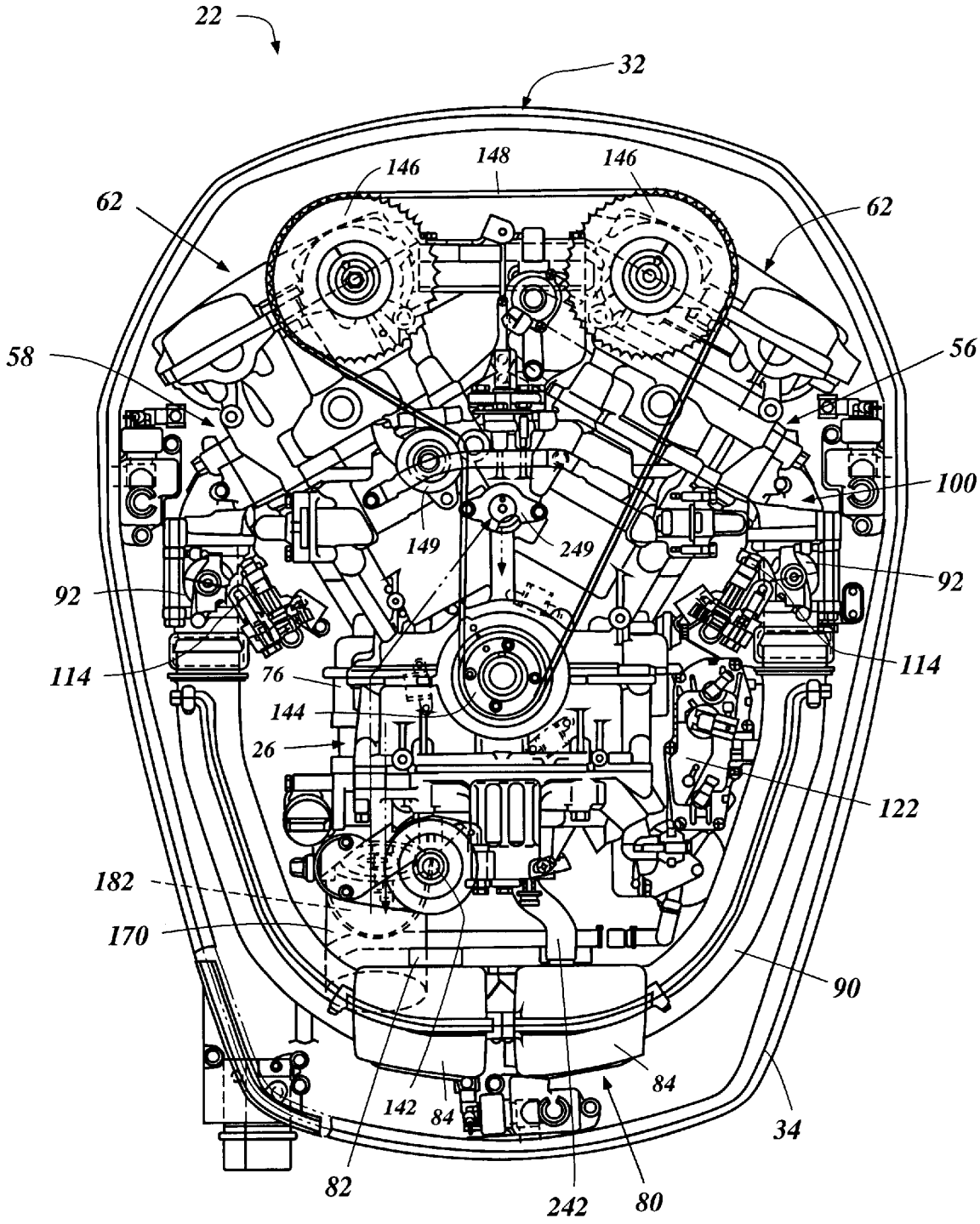
FIG. 2 is a top plan view of the outboard motor of FIG. 1 with the main cowling removed.
Figure 3:
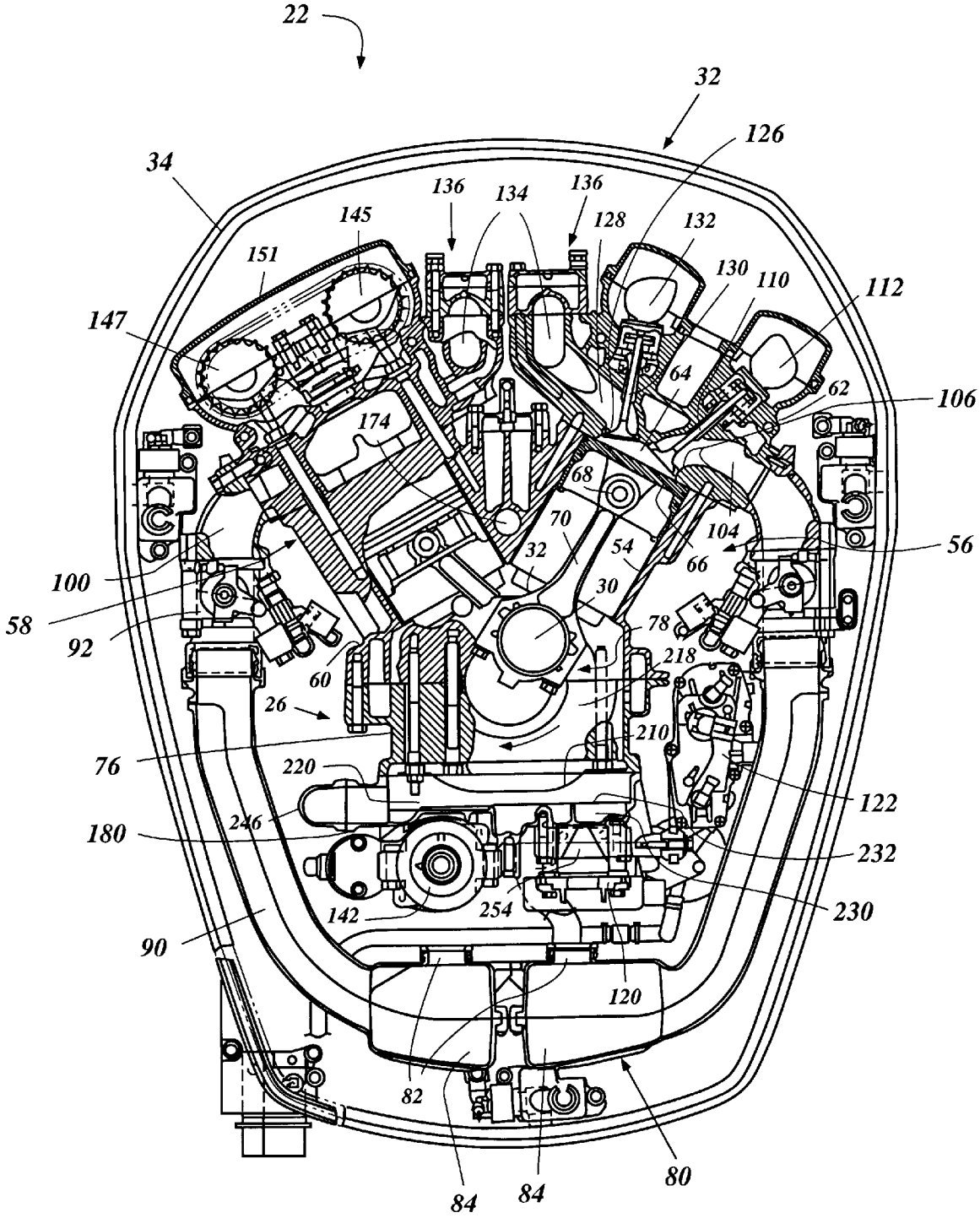
FIG. 3 is a sectioned top plan view of a portion of the outboard motor of FIG. 1.
Figure 4:
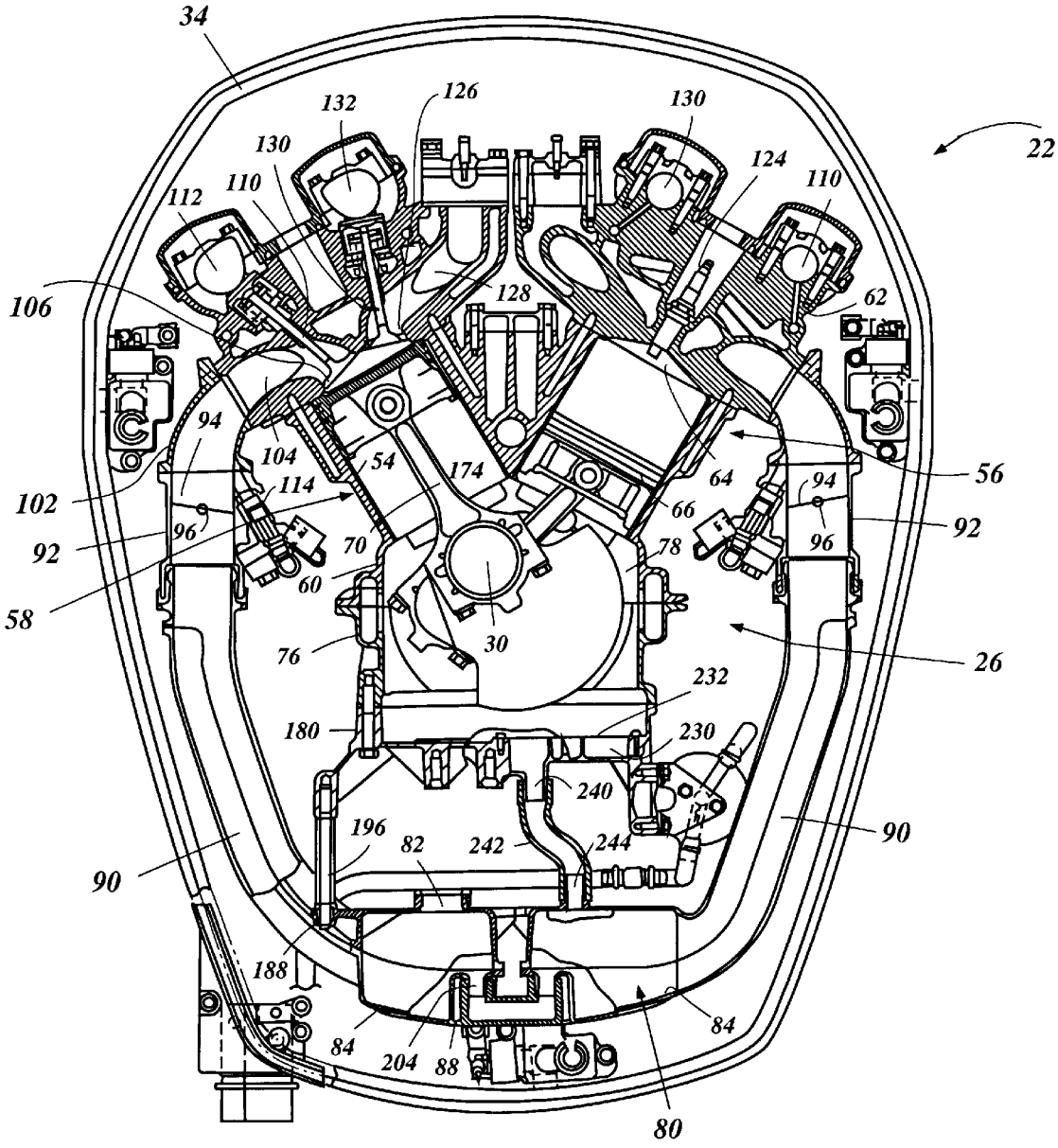
FIG. 4 is another sectioned top plan view of a portion of the outboard motor of FIG. 1.

With reference also to FIGS. 2–4, the illustrated engine 26 is preferably a six-cylinder, four-stroke engine. More preferably, the engine 26 is arranged in a V-6 configuration, meaning that the engine 26 has six cylinders 54 arranged in two distinct inclined cylinder banks of three cylinders 54, which two banks 56, 58, together form at least a portion of a cylinder block 60. In some arrangements, the engine 26 can have a greater or lesser number of cylinders 54, such as two, four, eight or more. Additionally, certain aspects of the present invention can also be used with engines having other cylinder arrangements such as, for example, but without limitation, an in-line arrangement, and also with engines operating after other combustion principles, such as two-stroke and rotary principles.

In the illustrated arrangement, a set of cylinder head assemblies 62 are connected to the two cylinder banks 56, 58. A combustion chamber 64 is defined in each cylinder 54 between a piston 66 and a lower surface of the cylinder head assembly 62.

The pistons 66 are movably positioned in each cylinder 54 and are adapted for reciprocating movement therein. Each of the pistons 66 is connected to a first end 68 of a corresponding connecting rod 70. A second end 72 of the connecting rod 70 is rotatably connected to a throw of the crankshaft 30. Thus, reciprocal movement of the pistons 60 is transposed into rotational movement of the crankshaft 30.

The crankshaft 30 preferably is journaled for rotation with respect to the cylinder block 60. A crankcase body 76 engages an end of the cylinder block 60 generally opposite the cylinder heads 62 and, together with the cylinder block 60, defines a crankcase chamber 78 enclosing the crankshaft 30. The structure of the crankcase body 76 and chamber 78 will be described in more detail below.

With continued reference to FIGS. 1–4, an induction and fuel delivery system is provided for delivering a fuel/air charge to each combustion chamber 64 for combustion therein. Generally, air is drawn by the induction system (i.e., as by suction caused by operation of the engine) through a vent (not shown) formed in the cowling 32. Preferably, the vent (not shown) is formed in an upper and rearwardly facing portion of the main cover portion 36 to reduce the induction of water or mist from the body of water in which the watercraft 28 is being operated.

From within the cowling 32, air is drawn into the induction system through an intake air silencer 80, positioned in a forward portion of the illustrated cowling 32. The air drawn from within the cowling 32 enters the illustrated intake silencer 80 through air inlets 82 formed near the top of the silencer 80. The silencer 80 preferably comprises two intake air chambers 84 that are formed generally separately from each other, but communicate with each other through a balance pipe 88, as shown in FIG. 4. Thus, while the intake air chambers 84 are generally separate from each other, air can flow between the chambers 84 through the balance pipe 88.

Figure 9:
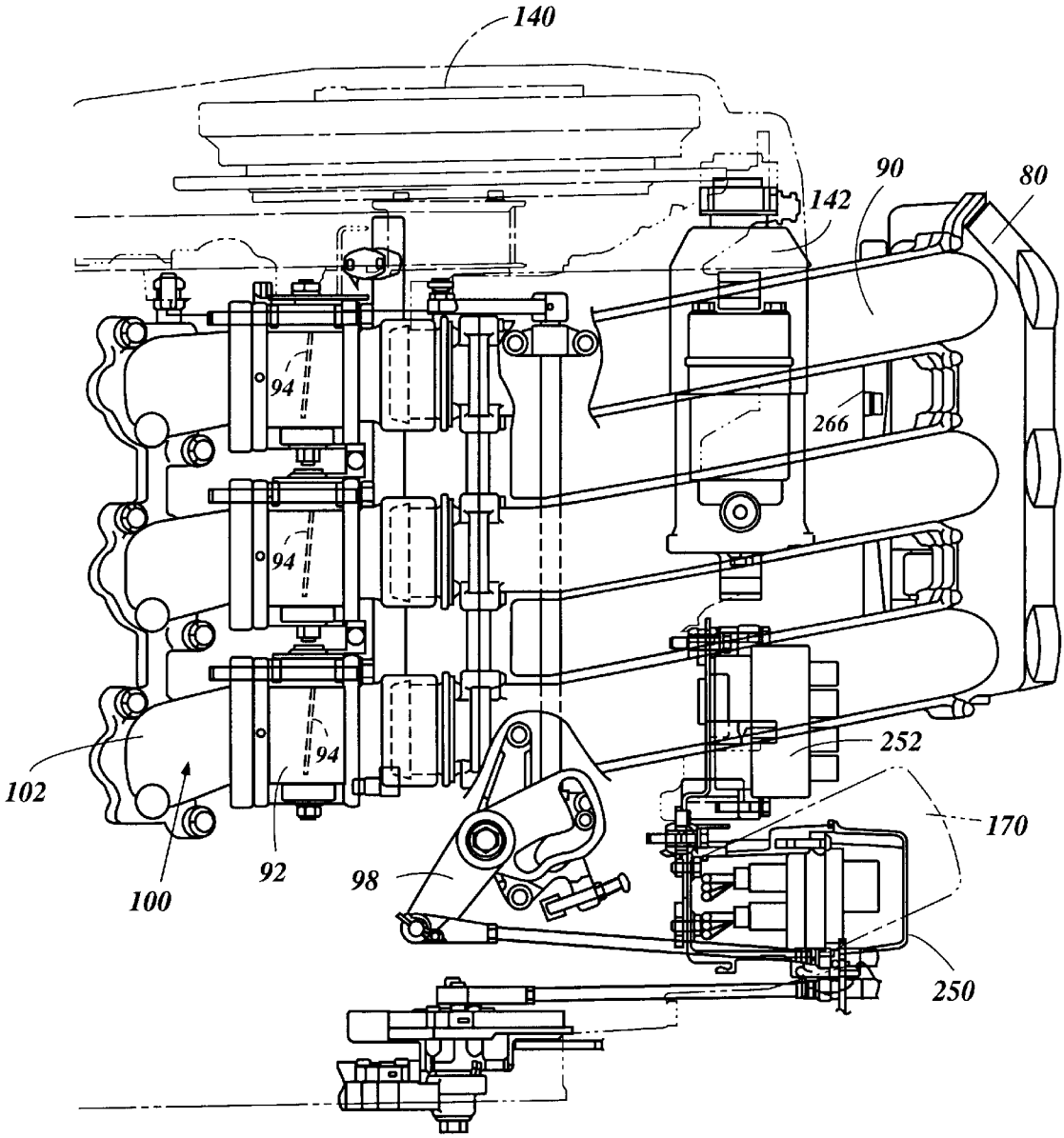
FIG. 9 is a side view showing the placement of various engine components relative to the induction system.

With reference also to FIG. 9, a plurality of intake pipes 90 extend from each silencer chamber 84 and direct air from the silencer 80 to the combustion chambers 64 of the engine 26. In the illustrated arrangement, one intake pipe 90 is provided for each cylinder 54 so that only one intake pipe 90 communicates with any one combustion chamber 64. The illustrated intake pipes 90 wrap around a portion of the cylinder block 60 and feature a configuration substantially corresponding to a shape of the inside of the main cowling 36. The intake pipes 90 and the intake silencer chambers 84 can be made of resin or of aluminum by a die-casting method. These components 84, 90 also can be integrally formed (i.e., formed as a unitary piece). Forming the intake silencer 80 as two separate chambers 84 simplifies assembling and/or maintenance work because the related components need only relatively rough accuracy in configuration and mount positions.

A throttle body 92 is interposed between the intake chamber 84 and each combustion chamber 64. Preferably, the throttle bodies 92 are positioned proximate the cylinder head 62 as illustrated in FIG. 2. As illustrated, a throttle valve 94 can regulate flow through the throttle body 92 by rotating inside the throttle body 92 about a throttle shaft 96. Thus, the rotation of the throttle valve 94 acts to regulate a flow of air through the throttle body 92. A link mechanism 98 (FIG. 9) controls rotation of the throttle valves 94 in response to inputs from a throttle control.

The throttle bodies 92 of each cylinder bank 56, 58 communicate with an intake manifold 100 associated with that cylinder bank 56, 58 of the engine 26. More specifically, each throttle body 92 communicates with an intake runner 102 of the intake manifold 100. The intake runner 102 leads to intake passages 104 formed in the cylinder head 62, which intake passages 104 lead to the combustion chambers 64 through corresponding intake ports 106.

In the illustrated engine 26, two intake ports 106 (see FIG. 1) are associated with each combustion chamber 64. With particular reference to FIGS. 3 and 4, an intake valve 110 is supported by the cylinder head assembly 62 and is adapted to regulate the flow through each intake passage 104 and corresponding intake port 106. An intake valve camshaft 112 is journaled within the cylinder head assembly 62 and actuates the intake valve 110 in a reciprocating manner, as is known in the art.

Figure 12:
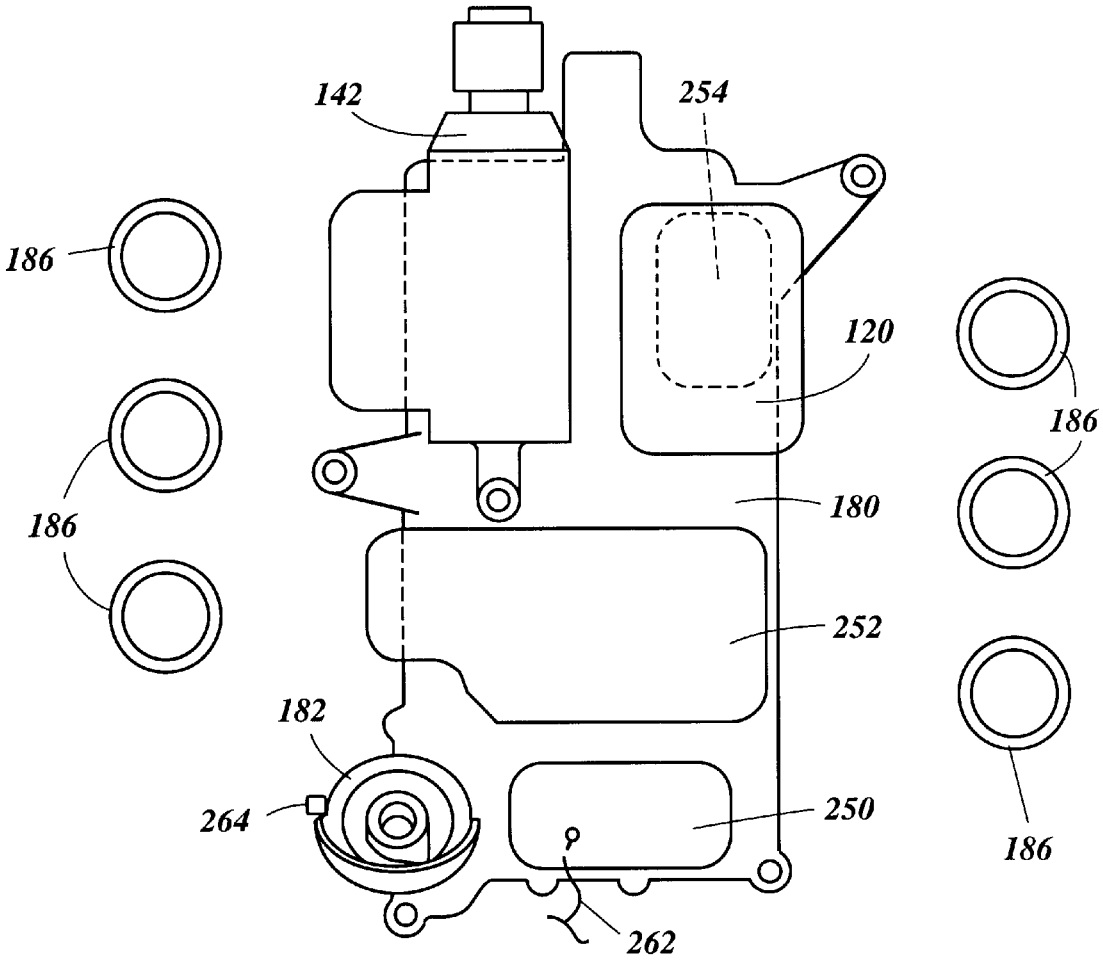
FIG. 12 is an elevational front view of the engine of the outboard motor of FIG. 1 showing the placement of certain components.

A fuel injector 114 communicates with the illustrated induction system downstream of the throttle valve 94 and upstream of the intake ports 106 to supply fuel to the air being drawn through the induction system. The fuel injectors 114 spray fuel into the intake passages 104 and are controlled by an ECU (Electronic Control Unit) 120 (FIGS. 3 and 12). As is well known in the art, the ECU 120 is configured to control the amount of fuel injected into the intake passage 104 and a timing of such fuel injection.

Fuel is delivered to the fuel injectors 114 from a fuel tank (not shown) by any suitable fuel pumping arrangement. The chosen pumping arrangement in the illustrated configuration includes a vapor separator 122 that separates air from the fuel prior to introduction to the fuel injector 114. Of course, the fuel injectors 114 can be positioned to inject fuel directly into the combustion chamber 64 (i.e., direct injection) rather than indirectly through the induction system (i.e., indirect injection) and can be positioned in other locations along the induction system. Moreover, certain features, aspects and advantages of the present invention can be used with carbureted engines as well.

Having introduced an air/fuel charge into the combustion chamber 64, a suitable ignition system ignites the charge within each combustion chamber 64. Such ignition systems are well known in the art and may include a spark plug 124 extending into the combustion chamber 64.

Following combustion, the exhaust gases must be discharged from the combustion chambers 64 to a point external of the outboard motor 20. The cylinder heads 62 preferably include exhaust ports 126 that allow exhaust gases to exit the combustion chamber 64 into corresponding exhaust passages 128. In the illustrated engine 26, two exhaust ports 126 are associated with each combustion chamber 64. An exhaust valve 130 is supported by the cylinder head assembly 62 and regulates flow through each exhaust passage 128 and exhaust port 126. An exhaust valve camshaft 132 is journaled within the cylinder head 62 and is adapted to actuate the exhaust valve 130 in a reciprocating manner similar to that of the intake valve 110 and intake valve camshaft 112.

The exhaust passages 128 form runners 134 of an exhaust manifold 136. Each cylinder bank 56, 58 preferably has a dedicated exhaust manifold 136. The exhaust manifold 136 directs exhaust downwardly into the lower exhaust passage 48 (see FIG. 1) and out of the motor 20 through the exhaust system.

With reference to FIGS. 1 and 2, a flywheel 140 is positioned above the illustrated cylinder block 60 and is adapted to rotate with the crankshaft 30. A starter motor 142 preferably is positioned adjacent the crankcase 78. The starter motor 142 drives a gear that selectively engages the flywheel 140 to start the engine 26, as is well known in the art. It is to be understood that although the flywheel 140 is disposed at the top of the illustrated engine 26, other arrangements are also possible. For example, the flywheel 140 can be positioned at the bottom of the engine 26.

Figure 5:
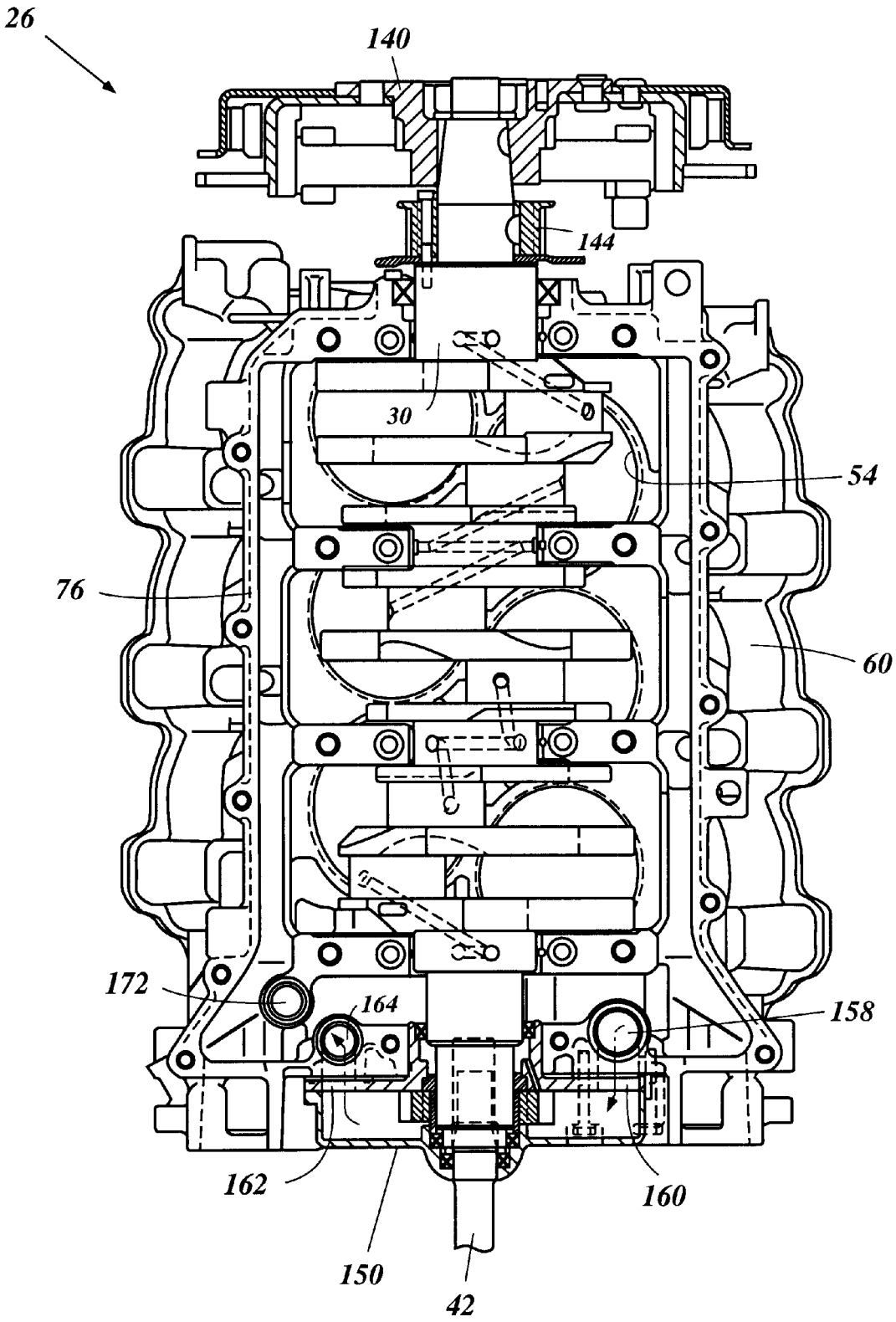
FIG. 5 is a partially sectioned front view of the engine of the motor of FIG. 1 with a crankcase body member removed.

With reference to FIGS. 1, 2 and 5, a drive pulley 144 is disposed on the crankshaft 30 below the flywheel 140. Driven pulleys 146 are disposed atop the exhaust camshafts 132 of the first and second cylinder banks 56, 58. The drive pulley 144 drives the driven pulleys 146 through a belt 148. An idler pulley 149 maintains appropriate tension on the belt 148. In order to drive the camshafts at one-half of the crankshaft speed, the driven pulleys 146 are generally twice the diameter of the drive pulley 144.

In the illustrated embodiment, the drive pulley 144 drives the exhaust cam shafts 132. The exhaust camshafts 132, in turn, drive the corresponding intake camshafts 112. A camshaft drive pulley 145 rotatably connected to the exhaust camshaft 132 drives a camshaft driven pulley 147 disposed on the intake camshaft 110 through a drive chain 151 (FIG. 3). In additional embodiments, either of the intake and exhaust camshafts of each camshaft pair can be driven directly by the drive pulley, and the driven camshaft can, in turn, drive the other camshaft of the pair through another belt/pulley system.

Figure 6:
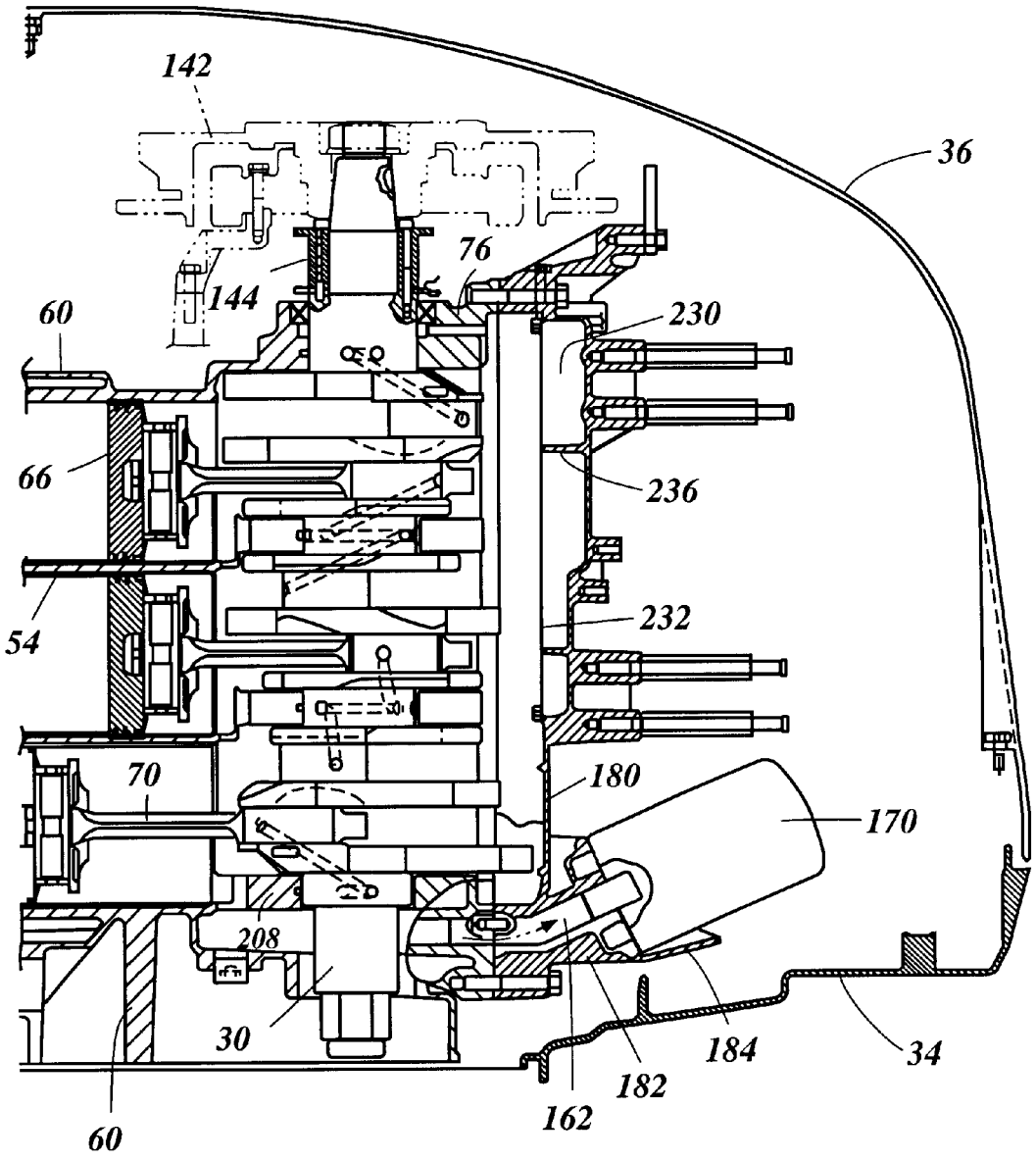
FIG. 6 is a sectional side view of a portion of the engine generally taken along a vertical plane extending through cylinder bores on one cylinder bank.

With next reference to FIGS. 1, 5 and 6, an oil pump 150 is provided at a bottom portion of the engine block 60 and crankcase body 76 for distributing lubricating oil to various engine parts. The oil pump 150 is positioned adjacent the output shaft 30 and is driven thereby. In the illustrated arrangement, the pump 150 unit is a rotary or trochoid pump. This type of pump, however, is merely exemplary of a type that can be used for the lubrication system. Other types of pumps such as, for example, a gear pump, can also be used.

An oil pan 152 depends into the driveshaft housing 24 and supplies oil to the oil pump 150. A suction pipe 154 depends into the oil pan 152 and communicates with an oil supply passage 158 formed in the crankcase body 76. A strainer 156 is positioned within the suction pipe 154.

The oil supply passage 158 communicates oil through an intake port 160 and into the oil pump 150. The oil pump 150 pressurizes the oil and pumps it out of an outlet port 162 into a discharge passage 164, which communicates the oil to an oil filter 170 (FIG. 6). From the oil filter 170, lubricant is delivered to a delivery passage 172 from which it is delivered to various portions of the engine 26. Most notably, the delivery passage 172 communicates oil to a main gallery 174 (FIGS. 2 and 3), which communicates oil to engine components in the crankcase chamber 78 and elsewhere.

Figure 7:
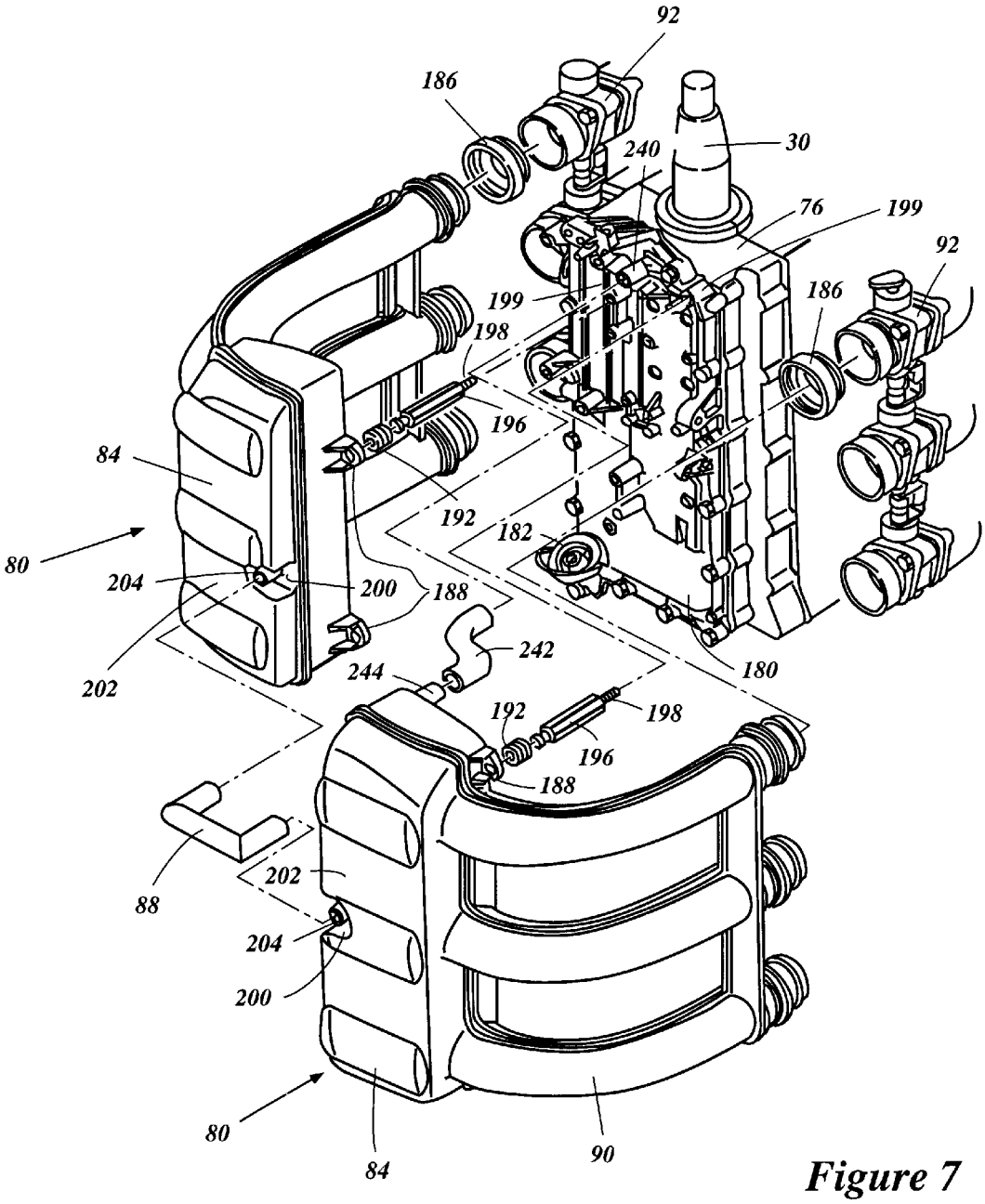
FIG. 7 is an exploded view of the engine including the crankcase member, the crankcase cover member, the crankshaft and a major portion of the air induction system with the electrical components omitted.

With next reference to FIGS. 6 and 7, a crankcase cover member 180 is attached to the crankcase body 76 and encloses the crankcase chamber 78. The oil filter 150 is mounted on a filter mount 182 disposed on the crankcase cover member 180. The discharge passages 164 extend through the crankcase cover 180 and into the filter mounting portion 182. The filter mount 182 is disposed so that an axis of the oil filter 170 is disposed in a generally upwardly-inclined disposition when the oil filter 170 is installed. A receiver 184 projects below the filter mount 182 to help guide the filter 170 during installation. Also, as can be seen in FIG. 9, the oil filter 170 is positioned below the intake silencer 80 and can be installed and removed without interfering with the silencer 80. Thus, changing the oil filter 170 is relatively easy.

With specific reference to FIG. 7, each intake chamber 84 of the intake silencer 80 is preferably attached to its associated intake pipes 90, which deliver air from the intake chamber 84 to the associated throttle bodies 92. The throttle bodies 92 are connected to a downstream end of each intake pipe 90. A rubber sealing member 186 is disposed between each intake pipe 90 and the corresponding throttle body 92.

Figure 8:
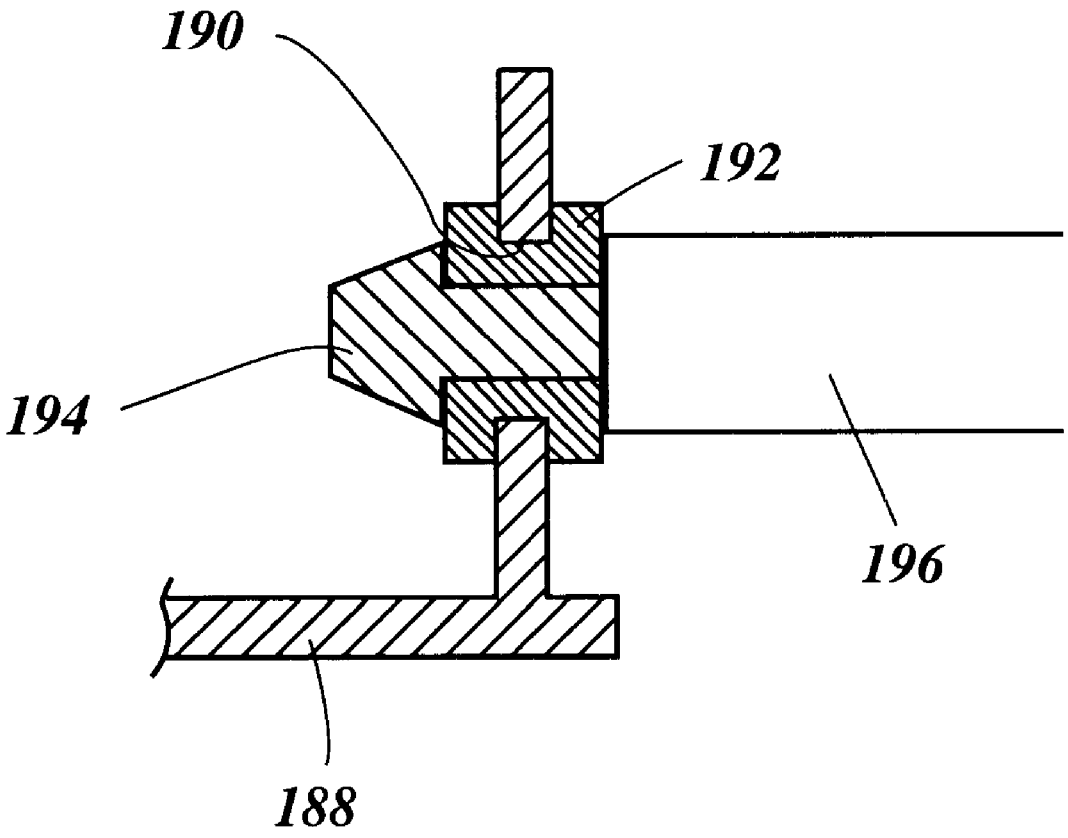
FIG. 8 is a cutaway side view of a mounting apparatus for the induction system of FIG. 7.

Each chamber 84 of the intake silencer 80 is removably attached to the crankcase cover 180. With reference also to FIG. 8, a plurality of mounts 188 extend from each chamber 84. Each mount 188 has a mount hole 190 through which a grommet 192 is fit. A tapered head 194 of a mounting rod 196 extends through the grommet 192, thus removably connecting the rod 196 to the mount 188. A threaded end 198 of the rod 196 is adapted to threadably engage a corresponding mount boss 199 on the crankcase cover 180.

Each intake chamber 84 has a recessed portion 200 formed in an outer shell 202 of the chamber 84. A connection port 202 is formed within each recessed portion 200. The balance pipe 88 is adapted to fit onto the connection port 202 of each chamber 84. In this manner, the balance pipe 88 communicates between the chambers 84, yet remains essentially flush with the outer surface of the chambers 84, as shown in FIG. 4.

With reference to FIGS. 3, 4, 10 and 11, the crankcase and the crankcase chamber 78 will now be described in greater detail. The crankshaft 30 is journaled between the cylinder block 60 and the crankcase body 76. Bearing blocks 208 rotatably support the crankshaft 30 within the crankcase chamber 78. A baffle plate 210 having a multitude of slit-like openings 212 is disposed between the crankcase body 76 and the crankcase cover member 180. A gasket 214 between the cover 180 and body 76 provides a sealing connection therebetween.

The baffle plate 210 divides the crankcase chamber 78 into a primary chamber 218 and a secondary chamber 220 (FIG. 3). Both chambers 218, 220 communicate with each other through the slits or through-holes 212 (FIG. 11) through the baffle plate 210. The primary chamber 218 has a larger capacity than the secondary chamber 220 and the crankshaft 30 is disposed in the primary chamber 218. As seen in FIG. 3, the baffle plate 210 bulges towards the secondary chamber 220.

After lubricating the respective engine components, lubricant oil drops through the crankcase chamber 78 and is returned to the oil pan 152 through a return passage. A portion of the lubricant hangs in the primary chamber 218 as a mist or vapor of lubricant entrained in air. The lubricant mist can move to the secondary chamber 220 through the slits 212 in the plate 210. Once it has moved to the secondary chamber 220, the rotational movement of the crankshaft 30 no longer influences the mist. Thus, much of the mist condenses back to a liquid state by adhering to the surface of the baffle plate 210 and an inner surface 224 of the crankcase cover 180. The liquid lubricant flows downwardly to the oil pan 152 along the surfaces of the baffle plate 210 and the crankcase cover 180.

The lubricant mist in the primary chamber 212 also includes blow-by gases. The blow-by gases comprise unburnt charges and a small amount of exhaust gases that have moved from the combustion chambers 64. Although the combustion chambers 64 are isolated by piston rings, those gases can leak to the crankcase chamber 78 because of the huge expansion pressure generated in the combustion chambers 64. In order to remove the blow-by gases and oil vapors that remain in the secondary chamber 220, a ventilation system is provided in the engine 26 of this arrangement.

Figure 10:
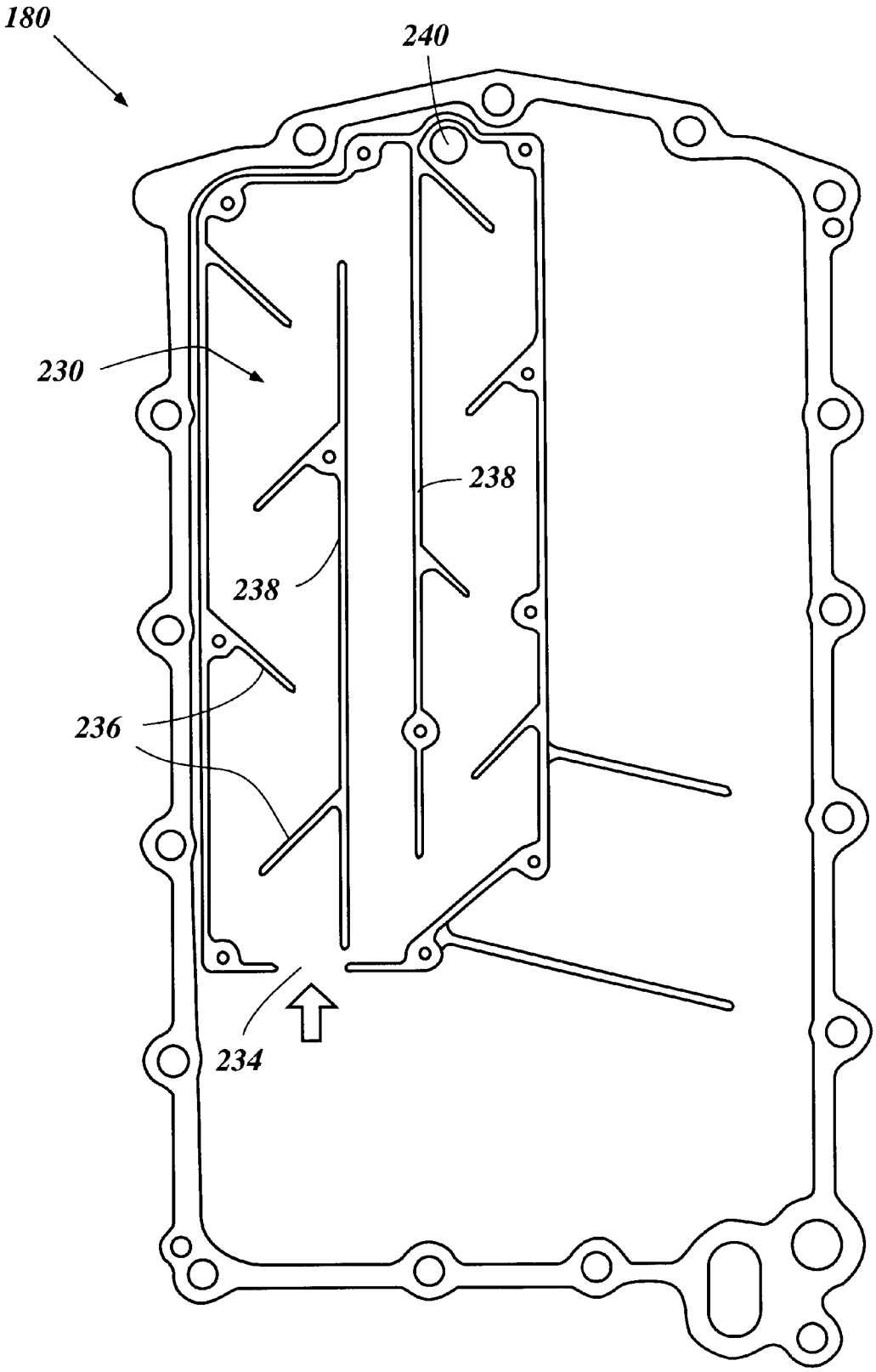
FIG. 10 shows an inner surface of a crankcase cover of the engine of the outboard motor of FIG. 1.

As shown in FIG. 10, the interior side 224 of the crankcase cover member 180 includes a breather chamber 230 for separating the entrained oil from the circulating air. A dividing plate 232 (see FIG. 3) generally separates the breather chamber 230 from the secondary crankcase chamber 220. An inlet 234 is formed at a bottom portion of the breather chamber 230, and air from the secondary crankcase chamber 220 is drawn therethrough. A plurality of baffles 236 and walls 238 provide a labyrinthine path through the breather chamber 230 to an outlet 240. The baffles 236 and walls 238 force the flowing air to change directions many times, thus helping to separate the entrained lubricant from the flow of air. Thus, most, if not all, of the oil is removed from the air by the time the air reaches the outlet 240. The removed oil flows downwardly out of the breather member 230 into the crankcase chamber 78.

With reference next to FIGS. 4 and 7, the outlet 240 extends through the crankcase cover member 180. A breather pipe 242 extends between the outlet 240 and a breather connector 244 formed in a chamber 84 of the intake silencer 80. Thus, air and blow-by gases from the crankcase 78 are ventilated into the intake silencer 80 and recirculated through the combustion chamber 64.

With reference again to FIGS. 3 and 11, an oil replenishment pipe 246 is preferably attached at the side of the crankcase cover member 180. The oil replenishment pipe 246 provides a means for adding lubricating oil to the lubrication system. A cap 248 is provided to selectively close the oil replenishment pipe 246. Additionally, a main gallery cap 249 is provided to close the main lubricant gallery 174.

With next reference to FIGS. 9 and 12, a plurality of electrical components are disposed on or adjacent the exterior surface of the crankcase cover 180. For example, the starter motor 142; a fuse box 250, which contains various fuses; a relay box 252, which contains various electrical relay elements; and an electronic control unit 120 (ECU) are disposed on the crankcase cover 180. A rectifier regulator 254, which converts AC current to DC current, is also disposed on the crankcase cover 180 adjacent the electronic control unit 120.

Power is supplied to these electrical components from a battery 260 disposed within the watercraft 28. Electrical cords 262 extend from the battery 260 to the electronic components mounted to the crankcase cover 180. Specifically, a negative terminal of the battery is connected directly to the crankcase cover 180 to provide a ground for the electrical components.

A hydraulic pressure alarm switch 264 is disposed adjacent the oil filter mount 182. The hydraulic pressure alarm switch 264 outputs an alarm 164 signal to the ECU 120 if the oil pressure inside a lubrication passage, such as the discharge passage 164, is determined to be below a predetermined pressure.

As discussed above, the air inlets 82 of the intake silencer 80 are disposed on the side of the silencer 80 facing the crankcase cover 180; thus, air will flow in the space 266 between the intake silencer 80 and the crankcase cover member 180. This flow of air will have a cooling effect on the electrical components mounted to the crankcase cover 180 between the cover and the intake silencer 80.

The arrangement of the electrical components and oil filter 170 on the front side of the crankcase cover 180 facilitates a decrease in the width of the outboard motor 20. Additionally, ease of access to the oil filter 170 is provided. Still further, since the various electrical components are located relatively close to one another, the need for extensive wiring to supply both power and grounding to such components is reduced. Accordingly, the engine compartment enclosed within the cowling 32 has a somewhat cleaner look and more organized arrangement.

Figure 11:
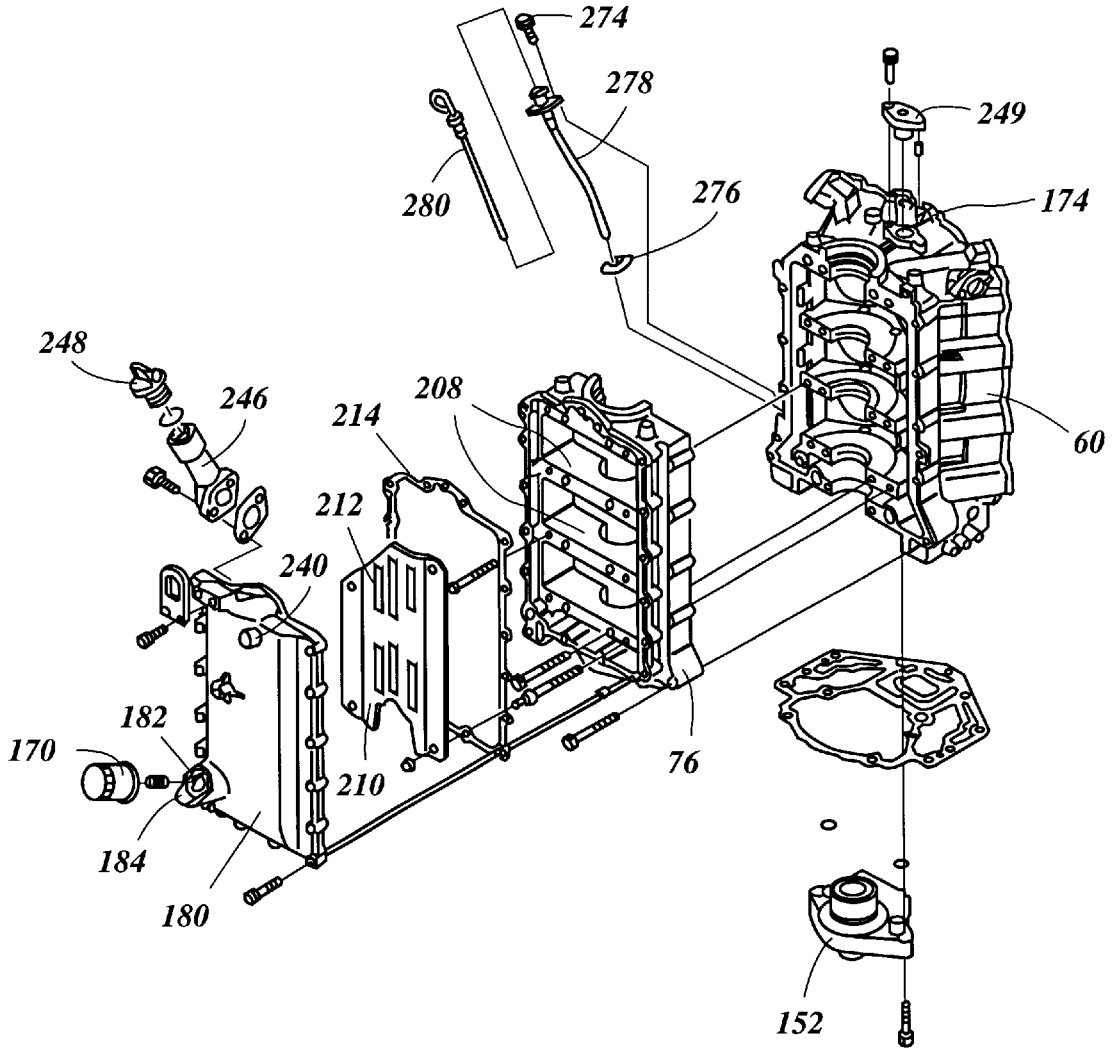
FIG. 11 shows a perspective exploded view of the engine of the outboard motor of FIG. 1.
Figure 13:
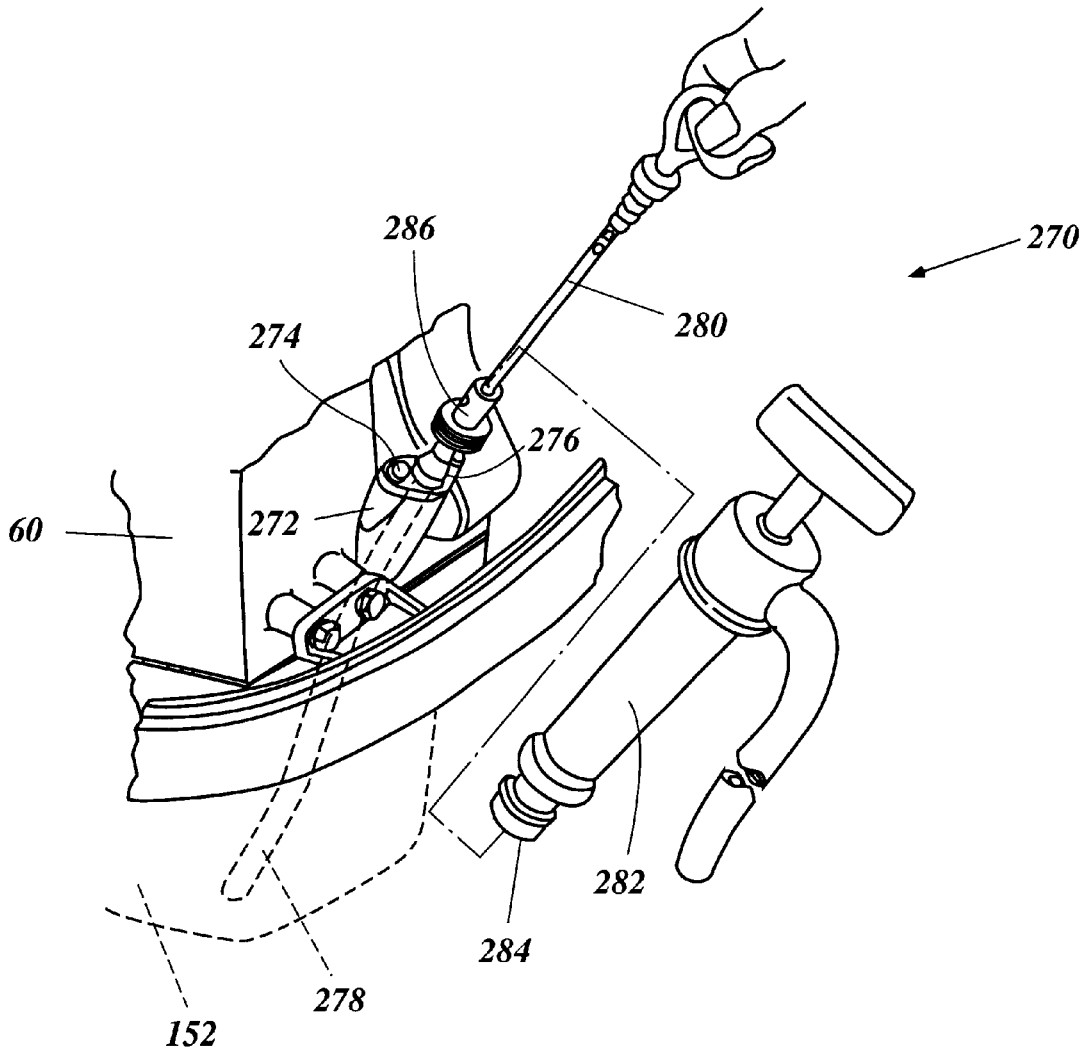
FIG. 13 shows an oil level gauge assembly of the outboard motor of FIG. 1.

With next reference to FIGS. 11 and 13, an oil level gauge assembly 270 is provided for determining the level of oil in the oil pan 152. A gauge mount 272 is preferably formed on a side of the cylinder block 60 and the assembly 272 is held in place by a bolt 274 and flange 276 that engage the gauge mount 272. An oil level gauge guide pipe 278 extends from the flange into the oil pan 152. An oil level gauge 280 is inserted into the guide pipe 278 and effectively plugs the pipe 278 during normal operation. To determine the oil level within the oil pan 150, the oil level gauge 280 can be removed and read in a conventional manner.

An oil drain pump 282 is illustrated in FIG. 13 and is adapted to empty the oil pan 152 when desired in order to change the engine oil. A connector 284 of the drain pump 282 is adapted to engage a proximal end 286 of the level gauge guide pipe 278 when the level gauge 280 has been removed from the pipe 278. With the drain pump 282 connected to the guide pipe 278, the drain pump 282 can pump oil through the guide pipe 278 to remove oil from the oil pan 152.

Although this invention has been disclosed in the context of a certain preferred embodiment, it will be understood by those skilled in the art that the present invention extends beyond the specifically disclosed embodiment to other alternative embodiments and/or uses of the invention and obvious modifications and equivalents thereof. In addition, while a number of aspects of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising a four-stroke engine and an induction system, the engine having a first bank of cylinders and a second bank of cylinders arranged generally in a "V" formation, each cylinder bank defining a plurality of cylinder bores communicating with a crankcase, a piston reciprocatably disposed in each cylinder bore and adapted to drive a substantially vertically-oriented crankshaft disposed in the crankcase, each cylinder bank having a cylinder head attached thereto, the cylinder head having at least one intake port formed therethrough and opening into an associated cylinder bore, an electrical ground wire disposed on the crankcase, a forward side of the crankcase being defined opposite the cylinder head, an electronic control unit, an electrical relay box, an electrical fuse box and a rectifier regulator all being disposed on the front side of the crankcase and having components that are grounded to the crankcase, the induction system comprising an intake silencer and a plurality of runners extending from the intake silencer to each of the intake ports, the intake silencer positioned forwardly of the crankcase.

2. An outboard motor as in claim 1, wherein a starter motor is disposed on the front surface of the crankcase, and components of the starter motor are grounded to the crankcase.

3. An outboard motor as in claim 1, wherein the intake silencer has an air inlet opening, and the inlet opening opens toward the crankcase, and the electronic control unit is disposed between the inlet opening and the crankcase.

4. An outboard motor as in claim 1, wherein an oil filter mount is disposed on the front surface of the crankcase.

5. An outboard motor as in claim 1, wherein the runners of the induction system extend along both sides of the engine.

6. A watercraft comprising an outboard motor and a battery, the outboard motor mounted onto a transom of the watercraft and comprising an internal combustion engine and an induction system for providing air to a combustion chamber of the engine, the engine comprising a substantially vertical crankshaft at least partially enclosed within a crankcase, an intake silencer of the induction system positioned forwardly of a front side of the crankcase, an electrical grounding line extending from the battery to the front side of the crankcase, and at least one electrical component is positioned between the crankcase and the intake silencer, the at least one electrical component being electrically grounded to the front side of the crankcase.

7. A watercraft as in claim 6, wherein the at least one electrical component is selected from the group consisting of an electronic control unit, an electrical relay box, an electrical fuse box, an electrical rectifier regulator and an oil pressure alarm switch.

8. A watercraft as in claim 7, wherein at least one of the electrical components is mounted on the front side of the crankcase.

9. A watercraft as in claim 8, wherein the intake silencer has an inlet, and the inlet opens toward the crankcase.

10. A watercraft as in claim 5, wherein the front side of the crankcase has an oil filter mount.

11. A watercraft as in claim 10, wherein the oil filter mount is positioned vertically lower than the induction system.

12. A watercraft as in claim 10, wherein the oil filter mount is inclined generally upwardly.

13. A watercraft as in claim 12, wherein the oil filter mount comprises a receiver portion extending outwardly from a lower portion of the mount.

14. An outboard motor comprising an internal combustion engine and an induction system enclosed within a cowling, the engine having an engine body defining at least one combustion chamber and a crankcase, the crankcase at least partially enclosing a substantially vertically-oriented crankshaft therein, the engine body having a front end on a side substantially opposite the at least one combustion chamber, at least a portion of the induction system disposed forwardly of the front end of the engine body, at least one electrical component being disposed between the front end of the engine body and the portion of the induction system disposed forwardly of the engine body, an electrical ground wire electrically communicating with the front end of the engine body, and the at least one electrical component is electrically grounded to the front end of the engine body.

15. An outboard motor as in claim 14, wherein the at least one electrical component is selected from the group consisting of an electronic control unit, an electrical relay box, an electrical fuse box, an electrical rectifier regulator and an oil pressure alarm switch.

16. An outboard motor as in claim 14, wherein at least one of the electrical components is mounted on the front side of the engine body.

17. An outboard motor as in claim 14, wherein an air inlet of the induction system opens toward the front end of the engine body.

18. An outboard motor as in claim 14, wherein the front of the engine body comprises a crankcase cover.

19. An outboard motor as in claim 18, wherein at least one of the electrical components is mounted on the crankcase cover.

20. An outboard motor as in claim 14, wherein the engine body defines at least one cylinder bore having a piston movably disposed therein.

21. An outboard motor as in claim 20, wherein the engine includes a first bank of cylinders and a second bank of cylinders arranged generally in a "V" formation.

22. An outboard motor as in claim 21, wherein the engine operates in accordance with a four-stroke combustion principle.

23. An outboard motor as in claim 22, wherein the induction system comprises an intake silencer and a plurality of intake pipes, and the intake silencer is at least partially positioned forwardly of the front end of the engine body and the intake pipes extend from the intake silencer along opposing sides of the engine body.

24. An outboard motor as in claim 23, wherein an oil filter mount is disposed on the front side of the engine body.

25. An outboard motor as in claim 24, wherein the oil filter mount is vertically lower than the intake silencer.

26. An outboard motor as in claim 14, wherein the front of the engine body comprises a crankcase cover and the engine body defines at least one cylinder bore having a cylinder movably disposed therein, and the engine operates in accordance with a four-stroke combustion principle.

27. An outboard motor as in claim 26, wherein a breather chamber is defined on a rear-facing side of the crankcase cover, and the breather chamber defines a labyrinthine path from an inlet to an outlet.

28. An outboard motor as in claim 27, wherein the outlet extends through the crankcase cover, and a breather pipe connects the outlet to the induction system.

29. An outboard motor comprising a power head having an engine generally enclosed within a cowling, the engine comprising a substantially vertical crankshaft at least partially enclosed within a crankcase, an electrical ground wire electrically communicating with a front side of the crankcase, and at least one electrical component disposed within the cowling and being electrically grounded to the front side of the crankcase.

30. The outboard motor of claim 29, wherein the front side of the crankcase comprises a crankcase cover.

31. The outboard motor of claim 30, wherein the electrical ground wire is directly connected to the crankcase cover.

32. The outboard motor of claim 30, wherein the crankcase cover additionally comprises a breather chamber communicating with an interior of the crankcase and adapted to separate entrained oil from air flowing therethrough.

33. The outboard motor of claim 32, wherein the breather chamber comprises at least one baffle.

34. The outboard motor of claim 30, wherein the at least one electrical component is mounted directly onto the crankcase cover.

35. The outboard motor of claim 29, wherein an oil filter mount is arranged on a front side of the crankcase, and a hydraulic pressure alarm switch is disposed adjacent the oil filter mount.

36. The outboard motor of claim 29, wherein an electronic control unit, a rectifier regulator, and a electrical relay box are mounted on and electrically grounded to the front side of the crankcase.

37. The outboard motor of claim 36 additionally comprising an intake silencer arranged forwardly of the front side of the crankcase and within the cowling, and the electronic control unit, rectifier regulator, and electrical relay box are disposed between the crankcase and the intake silencer.

38. An outboard motor comprising an internal combustion engine and an induction system enclosed within a cowling, the engine having an engine body defining a first bank of cylinders, a second bank of cylinders, and a crankcase, the cylinder banks arranged generally in a "V" formation, the crankcase at least partially enclosing a substantially vertically-oriented crankshaft therein, the induction system comprising an intake silencer and a plurality of intake pipes, the intake silencer at least partially positioned forwardly of a front end of the engine body, the intake pipes extending from the intake silencer along opposing sides of the engine body, an oil filter mount being disposed on the front side of the engine body and generally lower than the intake silencer, and at least one electrical component is disposed between the front end of the engine body and the intake silencer.

39. The outboard motor of claim 38, wherein a breather chamber is defined on the front end of the engine body and communicating with the crankcase, and the breather chamber defines a labyrinthine path from an inlet to an outlet.

* * * * *